US007934716B2

(12) United States Patent
Nagura

(10) Patent No.: US 7,934,716 B2
(45) Date of Patent: May 3, 2011

(54) PAPER SHEET SEPARATING AND ACCUMULATING APPARATUS

(75) Inventor: Akihiro Nagura, Nagakute (JP)

(73) Assignee: Hitachi-Omron Terminal Solutions Corp., Tokyo (JP)

( * ) Notice: Subject to any disclaimer, the term of this patent is extended or adjusted under 35 U.S.C. 154(b) by 42 days.

(21) Appl. No.: 12/277,722

(22) Filed: Nov. 25, 2008

(65) Prior Publication Data

US 2009/0152810 A1 Jun. 18, 2009

(30) Foreign Application Priority Data

Dec. 17, 2007 (JP) ..... 2007-324178

(51) Int. Cl.
*B65H 5/22* (2006.01)

(52) U.S. Cl. ..... 271/3.01; 271/3.08; 271/3.12; 271/3.09; 271/163; 209/534

(58) Field of Classification Search ..... 271/3.01, 271/3.08, 3.12, 163; 209/534
See application file for complete search history.

(56) References Cited

U.S. PATENT DOCUMENTS 5,042,790 A * 8/1991 Miller et al. ..... 271/110
6,290,410 B1 * 9/2001 Sunada et al. ..... 400/624
6,331,000 B1 * 12/2001 Beskitt et al. ..... 271/3.01
6,926,272 B2 * 8/2005 Carter et al. ..... 271/258.01
7,380,784 B2 * 6/2008 Mizuno ..... 271/207
7,431,293 B2 * 10/2008 Carter et al. ..... 271/303
7,677,545 B2 * 3/2010 Iwami et al. ..... 271/3.01
2004/0135304 A1 * 7/2004 Tokunaga et al. ..... 271/3.01
2008/0006564 A1 * 1/2008 Jeong ..... 209/534

FOREIGN PATENT DOCUMENTS

JP 2005255323 A * 9/2005

* cited by examiner

*Primary Examiner* — Stefanos Karmis
*Assistant Examiner* — Luis Gonzalez
(74) *Attorney, Agent, or Firm* — Brundidge & Stanger, P.C.

(57) ABSTRACT

The invention provides a paper sheet separating and accumulating apparatus which prevents a discharged paper money from entering into an accumulating carrier path in the case of discharging the paper money, and inhibits a jam from being generated. The paper sheet separating and accumulating apparatus is provided with a movable portion (for example, a stack guide, a detection lever, and a pressurized member) which is changed its position in correspondence to a movement of a paper sheet to a position at which an elevating plate discharges the paper sheet from an accumulating portion, and the movable portion is provided with a shielding portion (for example, a concavity and convexity of the movable portion and a shielding member) shielding a route from a two-way carrier path to an accumulating carrier path, in the case of discharging the paper sheet from the accumulating portion.

8 Claims, 7 Drawing Sheets

PAPER SHEET SEPARATING AND ACCUMULATING APPARATUS

INCORPORATION BY REFERENCE

The present application claims priority from Japanese application JP2007-324178 filed on Dec. 17, 2007, the content of which is hereby incorporated by reference into this application.

BACKGROUND OF THE INVENTION (1) Field of the Invention

The present invention relates to a paper sheet separating and accumulating apparatus separating and accumulating a paper sheet such as a paper money, a check or the like which is carried one by one.

(2) Description of Related Art

Conventionally, a paper money handling apparatus mounted to an automated teller machine, for example, used in a financial institution or the like has a paper money input and output port for discharging an output paper money to a user or inputting an input paper money so as to deliver one by one, a paper money discriminating portion discriminating the input paper money or the output paper money, a temporary storage portion temporarily storing the input paper money, and a reject box storing a reject paper money which does not reach a predetermined reference in the paper money discriminating portion, and further includes a recycling chamber for storing and keeping in trust the input paper money so as to deliver as the output paper money or the like, and a paper money carrier path connecting the portions.

The automated teller machine is advanced its downsizing and high capacity, and the paper money recycling chamber storing the paper money is demanded a downsizing of the paper sheet separating and accumulating apparatus in the paper money handling apparatus, and a high capacity of a storage space. In order to satisfy the demand mentioned above, the paper sheet separating and accumulating apparatus employed in the paper money recycling chamber employs a system separating and accumulating in one unit, in recent years.

As the conventional apparatus, for example, there has been proposed a paper sheet separating and accumulating apparatus shown in JP-A-2005-255323 (patent document 1).

In the paper money recycling chamber mentioned above, the paper sheet separating and accumulating apparatus employs the system separating and accumulating in one unit, however, in order to give and receive the paper money with respect to the close carrier path, there are independently provided an accumulating carrier path 310 (which is also called as an input money carrier path) for receiving the paper money from the carrier path so as to introduce to the accumulating portion, and a separating carrier path 311 (which is also called as an output money carrier path) for carrying the paper money discharged from the accumulating portion, and these two carrier paths are structured such as to be combined just before the separating and accumulating mechanism as shown in FIG. 8.

In the structure mentioned above, it is necessary to provide a switching mechanism short of a combined portion so as to prevent the paper money discharged from the separating and accumulating mechanism from entering into the accumulating carrier path 310.

However, since the paper sheet separating and accumulating apparatus is downsized and does not have a sufficient space, and it is hard to mount a sufficient switching mechanism, the embodiment mentioned above is structured such that a short split curtain is provided at a position where the accumulating carrier path 310 and the separating carrier path 311 are branched, in such a manner as to prevent the discharged paper money from entering into the accumulating carrier path 310, and the discharged paper money is introduced into the separating carrier path 311.

However, in the short split curtain type of branching system mentioned above, since the paper money carried from the accumulating carrier path 310 is carried to the accumulating portion while ducking under the short split curtain, it is necessary to set such a gap that the paper money can be carried in a lower portion of the short split curtain portion. Accordingly, in the case that the paper money having a bent leading end is discharged from the accumulating portion, there is a case that the paper money catches on the gap portion in the lower portion of the short split curtain, and a jam is generated.

BRIEF SUMMARY OF THE INVENTION

An object of the present invention is to provide a paper sheet separating and accumulating apparatus which prevents a discharged paper money from entering into or catching on an accumulating carrier path 310 in the case of discharging the paper money, and inhibits a jam from being generated.

In order to achieve the object mentioned above, the present invention employs a structure which is provided with a movable portion a position of which is changed in correspondence to a movement of a paper sheet to a position at which an elevating plate discharges the paper sheet from an accumulating portion, and is provided with a shielding portion shielding a path from a two-way carrier path to an accumulating carrier path in the movable portion in the case of discharging the paper sheet from the accumulating portion.

In other words, in accordance with the present invention, there is provided a paper sheet separating and accumulating apparatus including an accumulating portion having an elevating plate and accumulating a paper sheet on the elevating plate, an accumulating carrier path carrying the paper sheet accumulated in the accumulating portion, a separating carrier path carrying the paper sheet discharged from the accumulating portion, a two-way carrier path through which both of the accumulated paper sheet and the discharged paper sheet pass, a branch portion branching the two-way carrier path into the accumulating carrier path and the separating carrier path, and a movable portion moving in correspondence to an arrangement of the paper sheet to a position at which the elevating plate discharges the paper sheet from the accumulating portion, wherein the movable portion has a shielding portion shielding the path from the two-way carrier path to the accumulating carrier path, in the case of discharging the paper sheet from the accumulating portion.

Further, in the paper sheet separating and accumulating apparatus in accordance with the present invention, it is preferable that the movable portion is constituted by a stack guide coming to a guide accumulating the paper sheet in the case of accumulating the paper sheet to the elevating plate.

Further, in the paper sheet separating and accumulating apparatus in accordance with the present invention, it is preferable that the movable portion is constituted by a detection lever detecting the fact that the paper sheet exists at a position at which the paper sheet is discharged from the accumulating portion.

Further, in the paper sheet separating and accumulating apparatus in accordance with the present invention, it is preferable that the shielding portion is provided in a portion opposing to the branch portion in the movable portion.

Further, in the paper sheet separating and accumulating apparatus in accordance with the present invention, it is preferable that the shielding portion has a concavo-convex structure so as to oppose to the branch portion of the movable portion.

Further, in the paper sheet separating and accumulating apparatus in accordance with the present invention, it is preferable that the shielding portion is provided with a shielding member in a portion opposing to the branch portion of the movable portion.

Further, in the paper sheet separating and accumulating apparatus in accordance with the present invention, it is preferable that the accumulating carrier path is provided with a storage portion storing the shielding member, and the shielding member is stored in the storage portion in the case of accumulating the paper sheet in the accumulating portion.

Further, in accordance with the present invention, there can be provided an automated teller machine provided with any one of the paper sheet separating and accumulating apparatuses mentioned above.

In accordance with the present invention, the discharged paper does not enter into the accumulating carrier path in the case of discharging the paper money, and it is possible to inhibit a jam from being generated.

Other objects, features and advantages of the invention will become apparent from the following description of the embodiments of the invention taken in conjunction with the accompanying drawings.

DETAILED DESCRIPTION OF THE INVENTION

A description will be in detail given below of an embodiment in accordance with the present invention with reference to the accompanying drawings.

Embodiment 1

Figure 1:
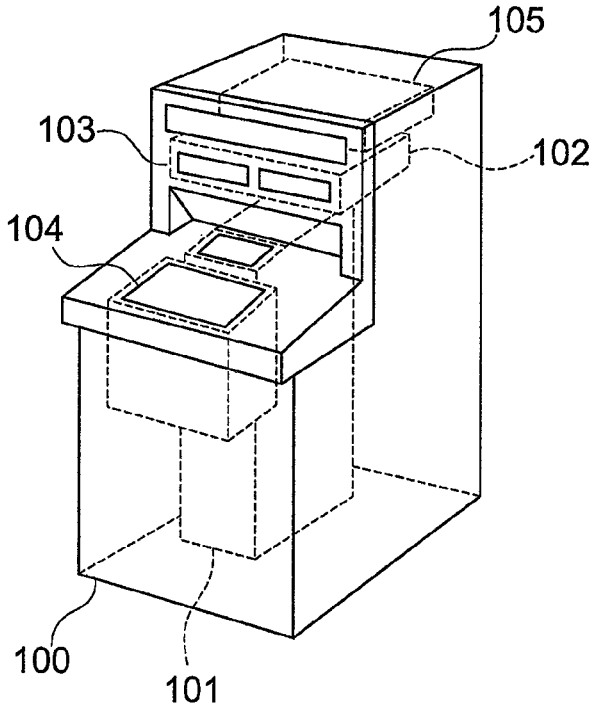
FIG. 1 is a perspective view showing an outer appearance of one embodiment of an automated teller machine to which the present invention is applied.

FIG. 1 is a perspective view showing an outer appearance of an automated teller machine 100. In FIG. 1, an internal portion of the automated teller machine 100 is constructed by a paper sheet handling apparatus (which is also called as a paper money handling apparatus) 101 to which a user inputs a paper money or which discharges the paper money to the user, a card and specified list handling apparatus 102 handling a card of the user and printing a transaction specified list so as to discharge, a passbook handling apparatus 103 writing up a transaction content in the passbook, a user operating portion 104 displaying an operation guide to the user and inputting an instruction from the user, a main body control portion 105 monitoring and controlling each of the apparatuses, and the like.

In this case, one example of the paper sheet is a paper money, and a description will be given next of the paper money handling apparatus 101 handling the paper money.

Figure 2:
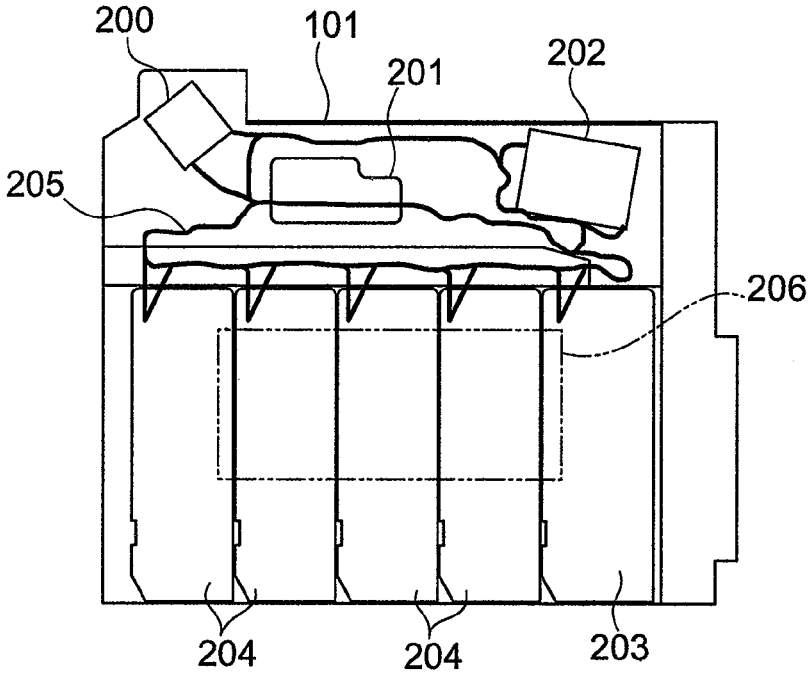
FIG. 2 is a side elevational view showing one embodiment of a paper money handling apparatus to which the present invention is applied.

FIG. 2 is a side elevational view showing a structure of the paper money handling apparatus 101.

In FIG. 2, the paper money handling apparatus 101 is constructed by a money input and output port 200 by which the user inputs and takes out the paper money, a paper money discriminating portion 201 discriminating the paper money, a temporary storage chamber 202 temporarily storing the input paper money until the transaction is effected, a reject box 203 storing the paper money in which the money input transaction is effected, a recycling chamber 204 serving both as the input money chamber and the output money chamber, a paper money carrier path 205 carrying the paper money to each of the units, and a control portion 206 monitoring and controlling each of the units.

The money input and output port 200 is structured such as to discharge the paper money input from the user to the paper money carrier path 205 one by one, and accumulate the paper money carried from the paper money carrier path 205 so as to discharge to the user. The paper money discriminating portion 201 measures an optical and magnetic feature of the paper money carried through the paper money carrier path 205, and discriminates a money kind, a truth and the like of the carried paper money.

The temporary storage chamber 202 is a storage chamber temporarily storing the carried paper money. For example, the paper money input by the user is temporarily stored by the temporary storage chamber 202, the paper money input by the user is stored in the recycling chamber 204 in the case that the user accepts the transaction, and the paper money input by the user is carried to the money input and output port 200 so as to be returned to the user in the case that the user does not accept. The reject box 203 is a safe storing the carried paper money, and stores the paper money only for input, and the paper money which is not suitable to be handled in the apparatus, such as the paper money having a cut or a bending, the obliquely carried paper money and the like.

The recycling chamber 204 has a paper sheet separating and accumulating apparatus which stores the paper money input by the user, discharges the stored paper money to the paper money carrier path 205 in correspondence to the transaction, and outputs to the user.

FIG. 2 is an example in which one reject box 203 is mounted, and three recycling chambers 204 are mounted, however, they can be freely combined, and a mounting number can be freely set. For example, it is possible to employ a combination including two reject boxes 203 and two recycling chambers 204.

The paper money carrier path 205 is constructed, for example, by a belt and a roller which are installed in such a manner as to pinch the paper money, and a driving motor driving the belt and the roller. Further, a switching gate driven by an electromagnetic solenoid is provided at a branch point of the paper money carrier path 205, and can switch a paper money carrier direction. Accordingly, the paper money passes through the paper money discriminating portion 201 in a two-way direction by switching a rotating direction of the driving motor and the switching gate per transaction, and is carried between the money input and output port 200, the temporary storage chamber 202, the reject box 203 and the recycling chamber 204.

The control portion 206 is connected to an actuator such as a driving motor of each of the units, an electromagnetic solenoid or the like, and a sensor, and controls the actuator while monitoring a state of the sensor in correspondence to the transaction. Further, the control portion 206 is connected to the main body control portion 105 of the automated teller machine 100, controls the paper money handling apparatus 101 on the basis of a command from the main body control portion 105, and informs the main body control portion 105 of a state of the paper money handling apparatus 101.

Figure 3:
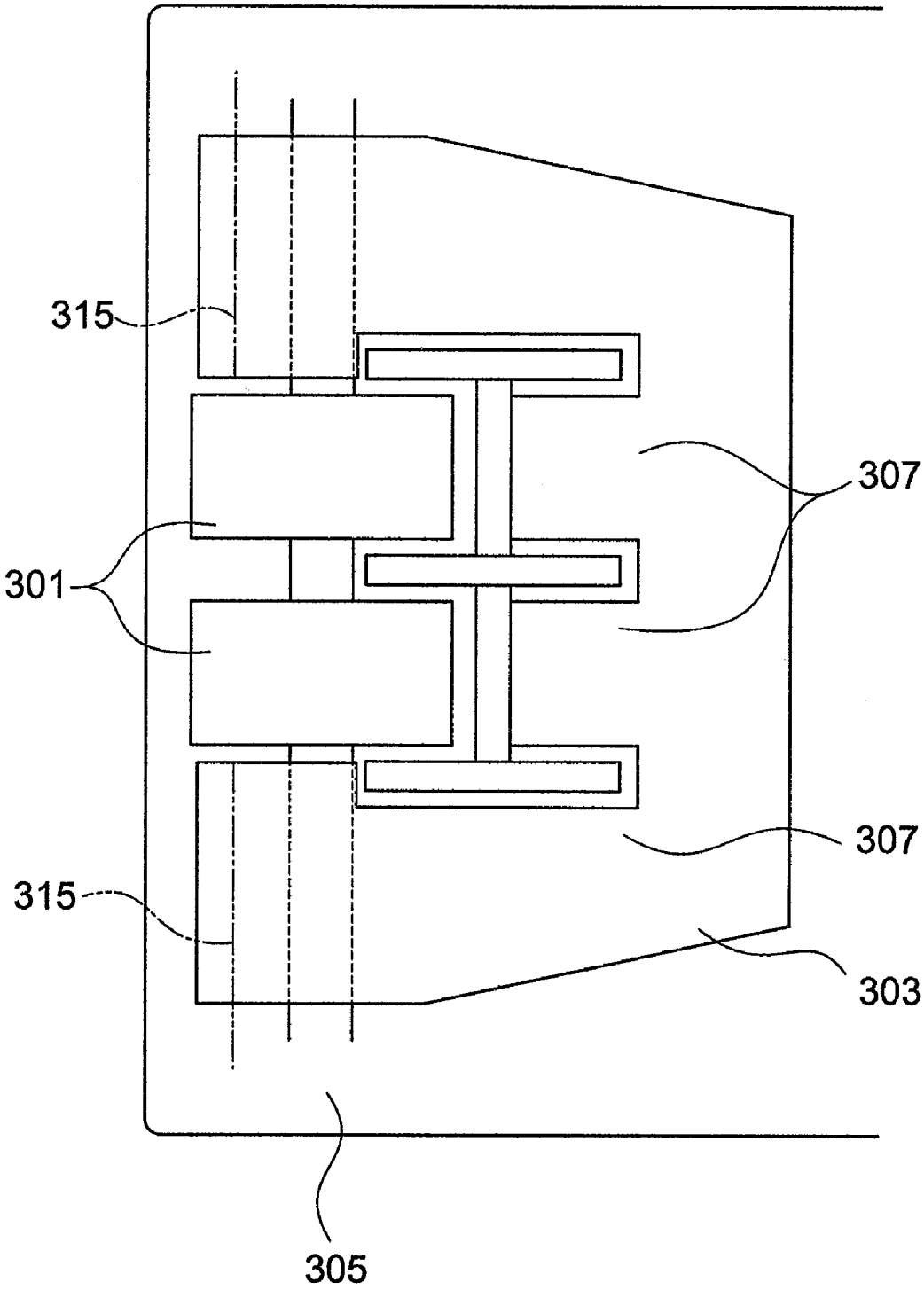
FIG. 3 is a top elevational view of a paper sheet separating and accumulating apparatus.

FIG. 3 is a view of the paper sheet separating and accumulating apparatus as seen from the above. A shielding portion 315 is provided in a portion opposing to a branch portion 313 of a stack guide 303, prevents the paper money from entering into the accumulating carrier path 310, and accumulates and discharges the paper money by a discharging and carrier roller 301.

Next, a description will be given of the paper sheet separating and accumulating apparatus of the recycling chamber 204 with reference to FIG. 4A.

Figure 4A:
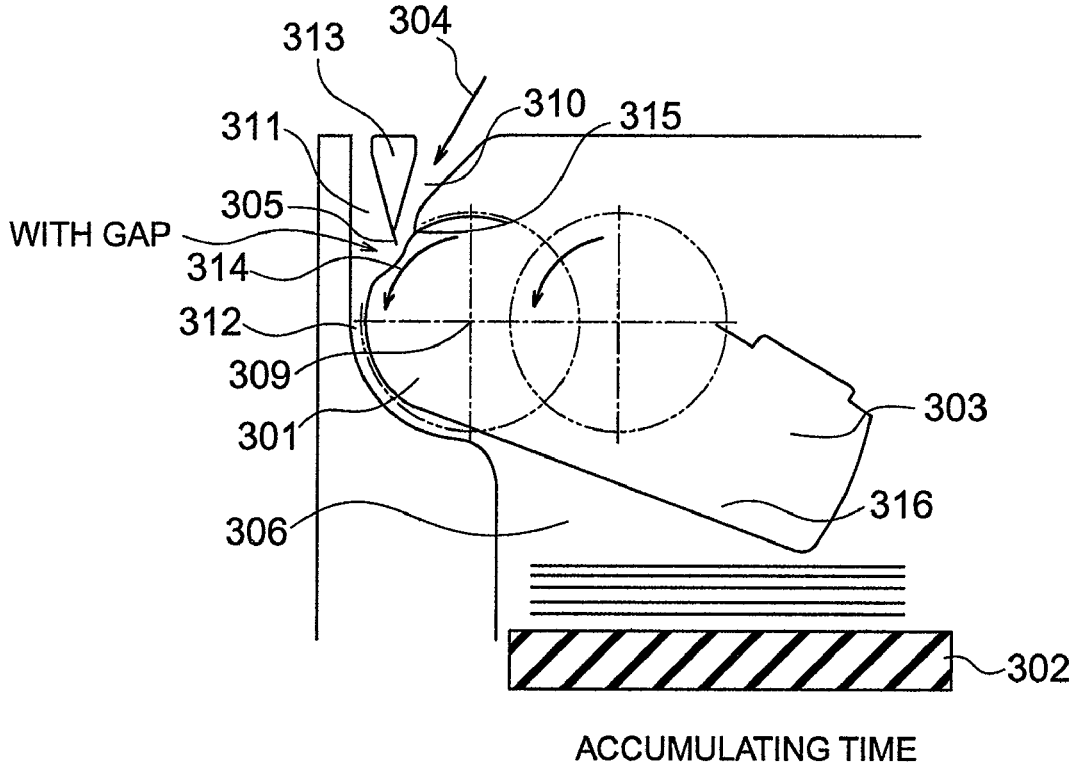
FIG. 4A is a side elevational view of the paper sheet separating and accumulating apparatus (an accumulating state of an embodiment using a stack guide)

FIG. 4A is a view of the paper sheet separating and accumulating apparatus as permeably seen from the side. The paper sheet separating and accumulating apparatus is constructed by the discharging and carrier roller 301, an elevating plate 302 moving up and down in an inner portion of the accumulating portion, a short split curtain guide 305, an accumulating portion 306 accumulating the paper sheet on the elevating plate 302, the stack guide 303 coming to a guide at a time of accumulating the paper money on the elevating plate 302, the accumulating carrier path 310 carrying the paper money accumulated in the accumulating portion 306, the separating carrier path 311 carrying the paper money discharged from the accumulating portion 306, a two-way carrier path 312 carrying the paper money accumulated in the accumulating portion 306 and the paper money discharged from the accumulating portion 306, and the shielding portion 315 which is provided with the branch portion 313 branching the two-way carrier path 312 into the accumulating carrier path 310 and the separating carrier path 311 (in which the branch portion 313 includes the short split curtain guide 305) and shields the paths of the two-way carrier path 312 and the accumulating carrier path 310.

In this case, in FIG. 4A, the shielding portion 315 (for example, a concavo-convex portion of the movable portion, and a shielding member) is provided in the stack guide 303, and the discharging and carrier roller 101 does not have the shielding portion. For explanation, an illustration is given by omitting a line of the portion opposing to the branch portion 313 of the discharging and carrier roller 101. The same matter is applied to FIGS. 4B, 5A and 5B.

First of all, a description will be given of a motion at a time of accumulating the paper money with reference to FIG. 4A.

The paper sheet carried to the recycling chamber 204 from a direction of an arrow 304 gets around a lower portion of the short split curtain guide 305 so as to be delivered to the two-way carrier path 312. The discharging and carrier roller 301 rotates in an accumulating direction 314 at this time, and the fed paper money is carried to the accumulating portion 306 of the paper in accordance with the rotation of the discharging and carrier roller 301, and is stacked on the elevating plate 302 of the accumulating portion 306 along the stack guide 303.

In the case of accumulating the paper money, the elevating plate 302 comes down and is controlled to such a height as to always keep a fixed accumulating space. The stack guide 303 rotates around a center of rotation 309, moves to a position at which a guide portion 316 of the stack guide 303 comes into contact with the accumulated paper money, and comes to an accumulation position state shown in FIG. 4A.

In this accumulation position state, the concave portion of the stack guide 303 is positioned at a position opposing to a leading end of the branch portion 313. Accordingly, a gap is formed between a leading end of the branch portion 313 and a portion opposing to the branch portion 313 of the stack guide 303, and the accumulated paper money is accumulated while passing through the gap between the leading end of the branch portion 313 and the stack guide 303. In other words, the paper money is accumulated in the accumulating portion 306 while passing through a gap of a route from the accumulating carrier path 310 to the two-way carrier path 312.

Figure 4B:
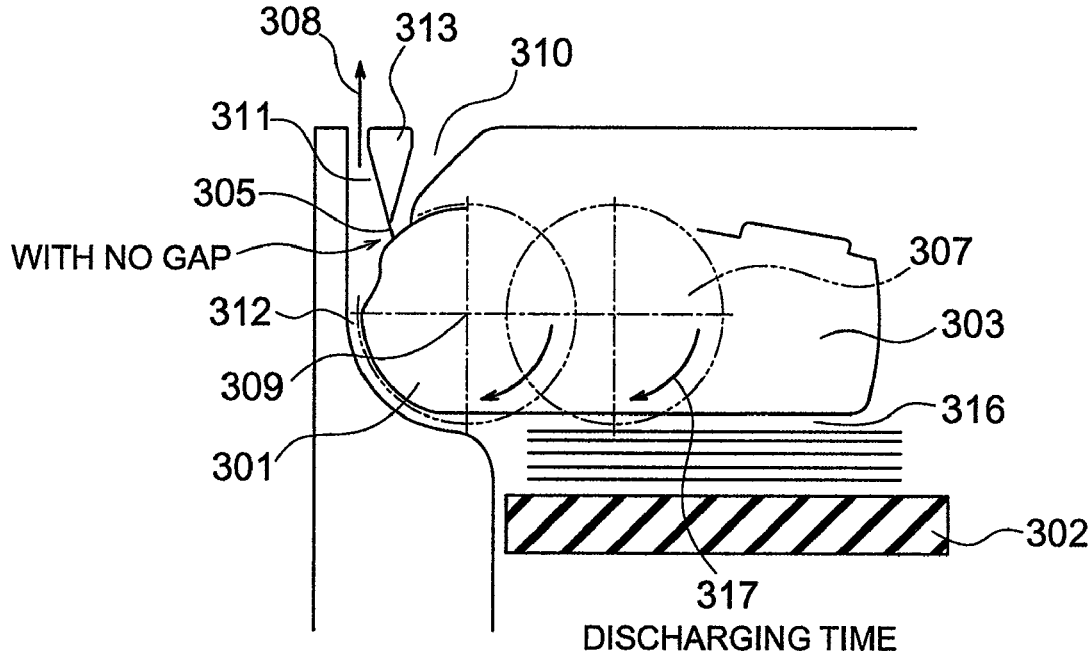
FIG. 4B is a side elevational view of the paper sheet separating and accumulating apparatus (a separating state of the embodiment using the stack guide)

Next, a description will be given of a motion at a time of separating the paper money with reference to FIG. 4B.

The paper money stacked on the elevating plate 302 is pressed to a pick roller 307 on the basis of a movement in an upward direction of the elevating plate 302 in the case of discharging the paper money. At this time, the guide portion 316 of the stack guide 303 is pushed up by the accumulated paper money on the elevating plate from an accumulated position state, rotates around the center of rotation 309, and comes to a separated position state shown in FIG. 4B.

In this state, the pick roller 307 rotates in a delivering direction 317 so as to deliver the paper money one by one and feed to the two-way carrier path 312. The paper money fed to the two-way carrier path 312 is separated by the discharging and carrier roller 301 one by one so as to be carried in a direction of an arrow 308. In the case that the paper money is discharged, the elevating plate 302 moves up and is controlled in such a manner that the paper money is always pressed to the pick roller 307.

Further, in the separated position state, the stack guide 303 moves in an upward direction in correspondence to the fact that the elevating plate 302 moves the paper money to the position at which the paper money is discharged from the accumulating portion 306, and the route from the two-way carrier path 312 to the accumulating carrier path 310 is shielded.

In other words, since the shielding portion 315 of the stack guide 303 is moved to the position opposing to the leading end of the branch portion 313, there comes to a state in which the gap between the branch portion 313 and the portion opposing to the branch portion 313 of the stack guide is closed. Accordingly, even in the case that the paper money having the deformed leading end portion is discharged, the leading end portion of the discharged paper money does not catch on the branch portion 313 of the short split curtain guide 305 or the like, and it is possible to stably carry the paper money in the direction of the arrow 308.

In the embodiment mentioned above, the concave portion is formed in the portion opposing to the branch portion 313 in the stack guide 303, however, there is a method of forming a convex portion in a portion opposing to the branch portion 313 in the stack guide 303. In other words, the convex portion of the stack guide 303 is positioned at a position opposing to the leading end of the branch portion 313 in a state in which the stack guide 303 comes to the separated position, and the route from the two-way carrier path 312 to the accumulating carrier path 310 is shielded. Further, a gap can be formed in such a manner that the paper money passes from the accumulating carrier path 310 to the two-way carrier path 312, in a state in which the stack guide 303 comes to the accumulated position.

In other words, since the shielding portion 315 has the concavo-convex structure, the gap is formed in the route from the two-way carrier path 312 to the accumulating carrier path 310 at a time of accumulating the paper money, and the route from the two-way carrier path 312 to the accumulating carrier path 310 may be shielded at a time of separating the paper money.

Figure 5A:
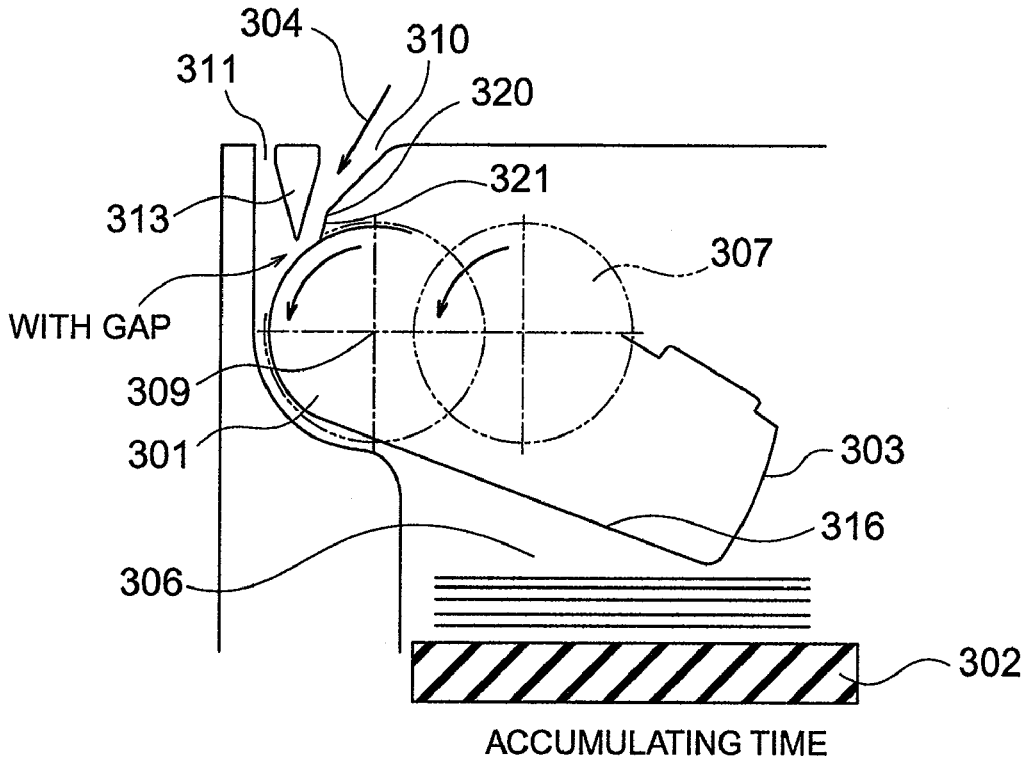
FIG. 5A is a side elevational view of the paper sheet separating and accumulating apparatus (an accumulating state of an embodiment using a member added to the stack guide)
Figure 5B:
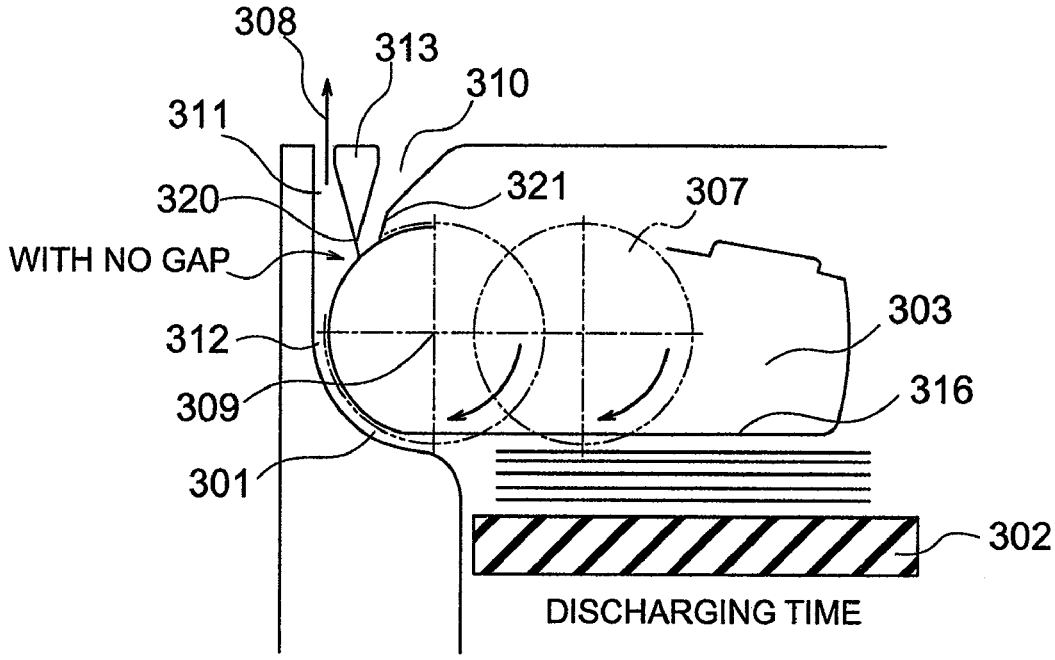
FIG. 5B is a side elevational view of the paper sheet separating and accumulating apparatus (a separating state of the embodiment using the member added to the stack guide)

FIG. 5A shows an accumulated position state in an embodiment in which a shielding member 320 is added to the portion opposing to the branch portion 313 of the stack guide 303. In comparison with FIG. 4A, the shielding member 320 is added to the portion opposing to the branch portion 313 of the stack guide 303, and the accumulating carrier path 310 is provided with a storage portion 321 which can store the shielding member 320 in the case of coming to the accumulated position state, in FIG. 5A. FIG. 5B shows a separated position state in the embodiment in which the shielding member 320 is added to the stack guide 303.

A description will be given of a motion of opening and closing the route from the two-way carrier path 312 to the accumulating carrier path 310 in the embodiment in which the shielding member 320 is added to the portion opposing to the branch portion 313 of the stack guide 303, with reference to FIGS. 5A and 5B.

As shown in FIG. 5A, in the case of accumulating the paper money, the elevating plate 303 comes down so as to be controlled at such a height as to keep a fixed accumulation space. In correspondence thereto, the stack guide 303 rotates around the center of rotation 309, and moves to a position at which the guide portion 316 of the stack guide 303 comes into contact with the accumulated paper money. Accordingly, the shielding member 320 of the stack guide 303 is stored in the storage portion 321, and a gap is formed between the portion opposing to the branch portion 313 of the stack guide 303 and the branch portion 313. In other words, the gap is formed in the route from the accumulating carrier path 310 to the two-way carrier path 312. The paper money is accumulated while passing through the gap between the leading end of the branch portion 313 and the stack guide 303.

In the case of separating the paper money, the paper is moved to a position at which the elevating plate 302 discharges the paper from the accumulating portion 306. In correspondence thereto, the shielding member 320 of the stack guide 303 moves to the position opposing to the leading end of the branch portion 313. Accordingly, the gap between the branch portion 313 and the portion opposing to the branch portion 313 of the stack guide 303 comes to the closed state. In other words, the route from the two-way carrier path 312 to the accumulating carrier path 310 is shielded.

In accordance with the structure mentioned above, it is not necessary to take into consideration the influence given to the paper money carrier by the shape of the portion opposing to the branch portion 313 of the stack guide 303 at a time of accumulating the paper money, and it is easy to form the portion opposing to the branch portion 313 of the stack guide 303 as the structure which is obtained by taking into consideration only the paper money carrier at a time of accumulating the paper money.

In this case, FIGS. 5A and 5B are not provided with the short split curtain guide 305, however, there is no problem in a structure in which the short split curtain guide 305 is provided in a part of the branch member 313.

Figure 6A:
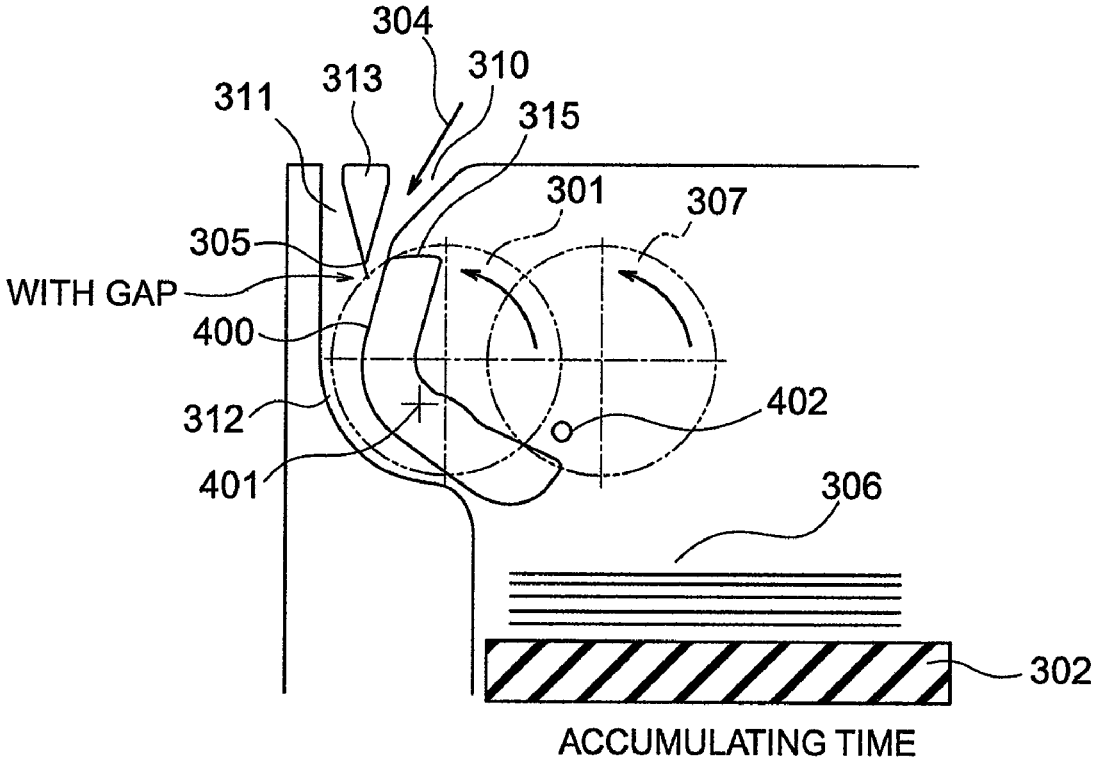
FIG. 6A is a side elevational view of a paper money accumulating portion (an accumulating state of an embodiment using a detection lever)
Figure 6B:
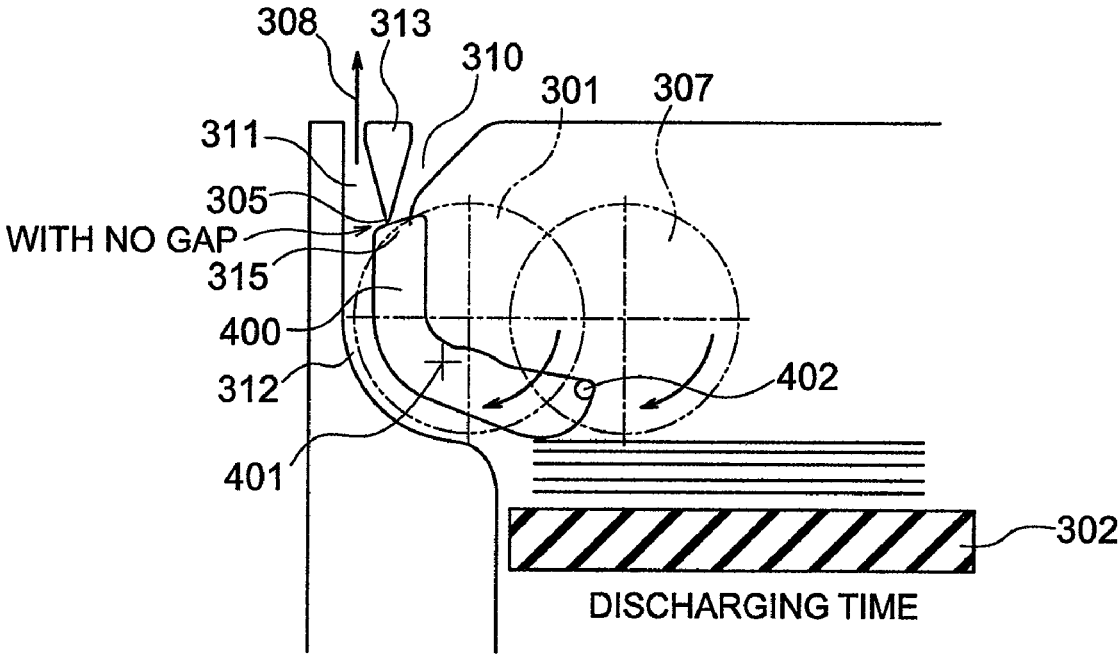
FIG. 6B is a side elevational view of the paper money accumulating portion (a separating state of the embodiment using the detection lever)

Further, FIG. 6A shows an accumulated position state of a detection lever 400 in the embodiment using the detection lever 400 for detecting the fact that the paper money exists at a discharging position corresponding to a position discharging the paper money. FIG. 6B shows a separated position state of the detection lever 400 in the embodiment using the detection lever 400.

The elevating plate 302 pushes up the paper money to the discharging position corresponding to the position in the case of discharging the paper money by the elevating plate 302, the detection lever 400 is pushed up by the pushed-up paper money, and a detection sensor 402 detects the detection lever 400, whereby the control portion 206 of the paper money handling apparatus 101 determines that the paper money exists at the discharged position, and discharges the paper money.

The detection lever 400 is structured such as to protrude to the route from the two-way carrier path 312 to the accumulating carrier path 310 in the case of discharging the paper money.

In the case of accumulating the paper money, the detection lever 400 moves downward, and a gap is generated between a portion opposing to a branch portion of the detection lever 400 and the short split curtain guide 305. In other words, the gap is generated in the route from the accumulating carrier path 310 to the two-way carrier path 312.

On the other hand, in the case of discharging the paper money, the elevating plate 302 moves the paper money from the accumulating portion 306 to the position discharging the paper money, whereby the detection lever 400 is pushed up by the accumulated paper money, and rotates around a center of rotation 401, the shielding portion 315 of the detection lever 400 moves to the position opposing to the short split curtain guide 305, and the gap is shielded between the portion opposing to the branch portion of the detection lever 400 and the short split curtain guide 305. In other words, the route from the two-way carrier path 312 to the accumulating carrier path 310 is shielded.

Figure 7A:
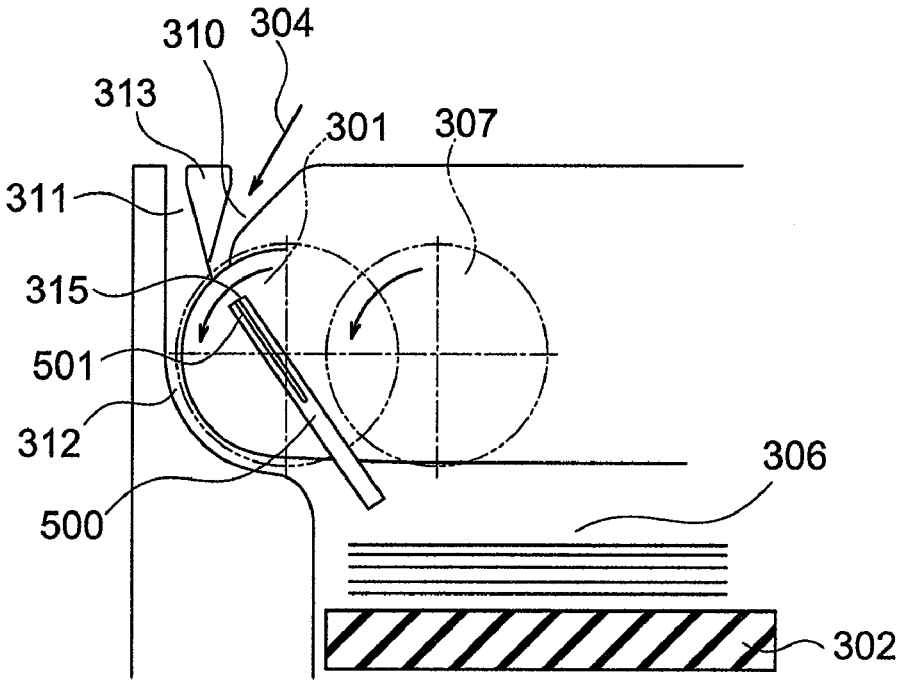
FIG. 7A is a side elevational view of a paper money accumulating portion (an accumulating state of an embodiment using a member receiving a pressure)
Figure 7B:
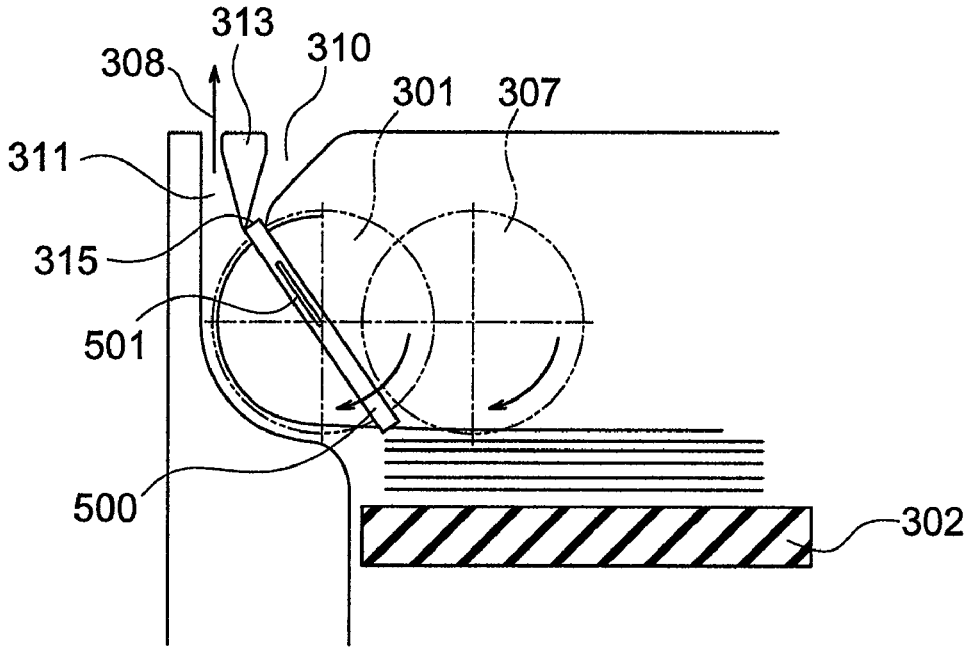
FIG. 7B is a side elevational view of the paper money accumulating portion (a separating state of the embodiment using the member receiving the pressure)
Figure 8:
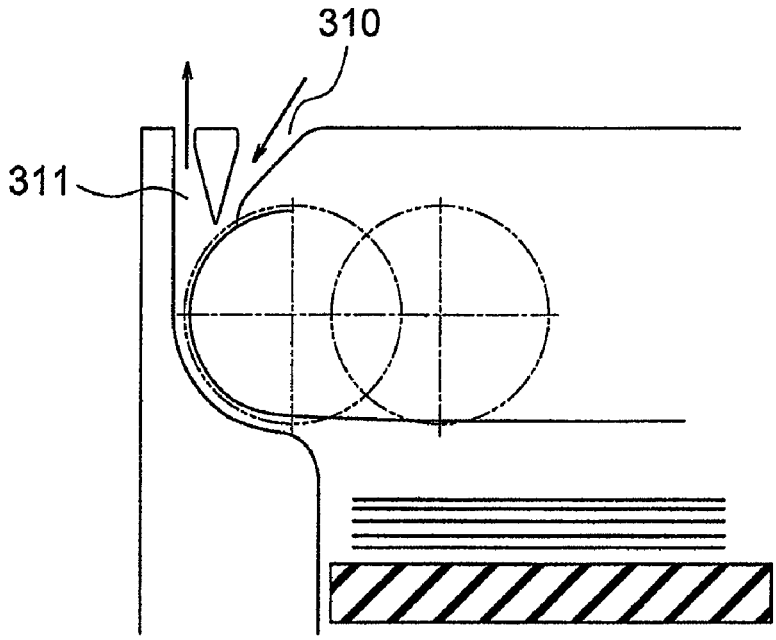
PRIOR ART FIG. 8
FIG. 8 is a side elevational view explaining a state of a conventional paper money accumulating portion.

Further, FIG. 7A shows an accumulated position state of a pressurized member 500 in an embodiment using a member 501 pressurized from the accumulated paper money. FIG. 7B shows a separated position state of the pressurized member 501 in the embodiment using the member 500 pressurized from the accumulated paper money. In this case, the pressurized member 500 is structured such as to be stopped by the stopper 501.

In the case of accumulating the paper money, the pressurized member 500 is moved downward, and is stopped by the stopper 501, and a gap is formed between the short split curtain guide 305 and a portion opposing to the branch portion of the pressurized member. In other words, the gap is formed in the route from the accumulating carrier path 310 to the two-way carrier path 312.

On the other hand, in the case of discharging the paper money, the member 500 pressurized by the accumulated paper money is pushed up by moving the paper money to the position at which the elevating plate 302 discharges the paper money from the accumulating portion 306, and the shielding portion 315 of the pressurized member 500 shields between the short split curtain guide 305 and the portion opposing to the branch portion of the pressurized member on the basis of the pressure of the paper money accumulated in the accumulating portion 306. In accordance with the structure mentioned above, it is possible to easily shield the route from the two-way carrier path 312 to the accumulating carrier path 310.

Further, the structure may be made such that the shielding member is added to the portion opposing to the branch portion 313 of the detection lever 400 or the pressurized member 500, and a space storing the shielding member is provided in the accumulating carrier path 310.

As mentioned above, in accordance with the present embodiment, the paper sheet separating and accumulating apparatus is provided with the movable portion (for example, the stack guide, the detection lever, and the pressurized member) which is movable by moving the paper sheet to the position at which the elevating plate discharges the paper sheet from the accumulating portion, and the movable portion having the shielding portion (for example, the concavity and convexity of the movable portion and the shielding member) shielding the route from the two-way carrier path to the accumulating carrier path, and it is possible to easily open and close the route from the two-way carrier path 312 to the accumulating carrier path 310.

Further, the arranged position of the shielding portion may be adjusted in correspondence to the kind and the state of the carried paper sheet or the structure of the other portion of the paper sheet separating and accumulating apparatus.

In this case, the embodiment mentioned above is described by exemplifying the paper money, however, it goes without saying that the paper sheet is not limited to the paper money.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A paper sheet separating and accumulating apparatus comprising:

an accumulating portion having an elevating plate and being arranged to accumulate paper sheets on said elevating plate;

an accumulating carrier path through which the paper sheets enter into said accumulating portion to be accumulated on said elevating plate;

a separating carrier path through which paper sheets are discharged from said accumulating portion;

a two-way carrier path through which both of said accumulated paper sheets and said discharged paper sheets pass;

a branch portion branching said two-way carrier path into said accumulating carrier path and said separating carrier path; and a movable portion that is movable upon being pressed by the paper sheets accumulated on said elevating plate to a sheet discharge position at which said elevating plate is positioned to discharge the paper sheets from said accumulating portion, wherein said movable portion has a shielding portion arranged to shield said two-way carrier path from said accumulating carrier path upon said movable portion being moved to said sheet discharge position.

2. A paper sheet separating and accumulating apparatus as claimed in claim 1, wherein said movable portion includes a stack guide arranged to guide the paper sheets onto said elevating plate from said accumulating carrier path.

3. A paper sheet separating and accumulating apparatus as claimed in claim 1, wherein said movable portion includes a detection lever arranged to detect that a paper sheet is positioned for discharge from said accumulating portion.

4. A paper sheet separating and accumulating apparatus as claimed in claim 1, wherein said shielding portion is provided in a portion opposing to said branch portion in said movable portion.

5. A paper sheet separating and accumulating apparatus as claimed in claim 1, wherein said shielding portion has a concavo-convex structure so as to oppose said branch portion of said movable portion.

6. A paper sheet separating and accumulating apparatus as claimed in claim 1, wherein said shielding portion has a shielding member in a portion opposing to the branch portion of said movable portion.

7. A paper sheet separating and accumulating apparatus comprising:

an accumulating portion having an elevating plate and accumulating a paper sheet on said elevating plate;

an accumulating carrier path carrying the paper sheet accumulated in said accumulating portion;

a separating carrier path carrying the paper sheet discharged from said accumulating portion;

a two-way carrier path through which both of said accumulated paper sheet and said discharged paper sheet pass;

a branch portion branching said two-way carrier path into said accumulating carrier path and said separating carrier path; and a movable portion moving in correspondence to an arrangement of the paper sheet to a position at which said elevating plate discharges the paper sheet from said accumulating portion, wherein said movable portion has a shielding portion shielding the path from said two-way carrier path to said accumulating carrier path, in the case of discharging the paper sheet from said accumulating portion, wherein said shielding portion has a shielding member in a portion opposing to the branch portion of said movable portion, and wherein said accumulating carrier path is provided with a storage portion storing said shielding member, and said shielding member is stored in said storage portion in the case of accumulating the paper sheet in said accumulating portion.

8. An automated teller machine comprising:

a paper sheet separating and accumulating apparatus comprising:

an accumulating portion having an elevating plate and being arranged to accumulate paper sheets on said elevating plate;

an accumulating carrier path through which the paper sheets enter into said accumulating portion to be accumulated on said elevating plate;

a separating carrier path through which the paper sheets are discharged from said accumulating portion;

a two-way carrier path through which both of said accumulated paper sheets and said discharged paper sheets pass;

a branch portion branching said two-way carrier path into said accumulating carrier path and said separating carrier path; and a movable portion that is movable upon being pressed by the paper sheets accumulated on said elevating plate to a sheet discharge position at which said elevating plate is positioned to discharge the paper sheets from said accumulating portion, wherein said movable portion has a shielding portion arranged to shield said two way carrier path from said accumulating carrier path upon said movable portion being moved to said sheet discharge position.

* * * * *